US007698843B2

(12) United States Patent
Hillstrom et al.

(10) Patent No.: US 7,698,843 B2
(45) Date of Patent: Apr. 20, 2010

(54) FLEXIBLE SIGN MOUNT

(75) Inventors: David U. Hillstrom, Hancock, MI (US); Alan J. Adilman, West Bloomfield, MI (US); Thomas E. Pilarczyk, Brighton, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 316 days.

(21) Appl. No.: 11/685,968

(22) Filed: Mar. 14, 2007

(65) Prior Publication Data

US 2007/0214693 A1 Sep. 20, 2007

Related U.S. Application Data

(60) Provisional application No. 60/782,334, filed on Mar. 14, 2006.

(51) Int. Cl.
*G09F 17/00* (2006.01)

(52) U.S. Cl. ..... 40/604; 248/121; 248/218.4; 248/458; 248/624; 40/602; 40/611.06; 40/612; 40/606.14

(58) Field of Classification Search ..... 248/121, 248/122.1, 218.4; 40/606.01, 607.01, 607.05, 40/607.1, 607.11, 607.12
See application file for complete search history.

(56) References Cited

U.S. PATENT DOCUMENTS 2,961,787 A * 11/1960 Kies ..... 40/604
3,662,482 A * 5/1972 Sarkisian ..... 40/602
4,572,473 A * 2/1986 Seely ..... 248/624
4,951,906 A * 8/1990 Morey ..... 248/201
5,319,870 A * 6/1994 Weiss ..... 40/606.14
5,428,913 A * 7/1995 Hillstrom ..... 40/604
D427,242 S 6/2000 Pettesch
6,976,660 B2 * 12/2005 Lapointe et al. ..... 248/218.4

OTHER PUBLICATIONS

Universal Signage Systems, BumperBoard brochure page—www.universalvalve.com/catalog/single%20pages%203-18-04/1999-2844.pdf,2003, 1 pg.

Universal Signage Systems—www.universalvalve.com/PDFs/signageBrochure4-26-06.pdf 2 pgs.

* cited by examiner

*Primary Examiner*—Lesley Morris
*Assistant Examiner*—Shin Kim
(74) *Attorney, Agent, or Firm*—Harness, Dickey & Pierce, P.L.C.

(57) ABSTRACT

A flexible mounting system for supporting a sign from a rigid structure for minimizing damage that might result from an impact force on the sign is disclosed. The flexible mounting system includes a flexible sign mount having a support bracket secured to a sign and a stationary bracket releasably securable to a rigid structure such a bollard. A flex element can be interposed between the support bracket and the stationary bracket to permit the sign to translate and rotate relative to the rigid support when the sign is subjected to an impact load.

21 Claims, 8 Drawing Sheets

210
22
12
22
30
102
234
254
220
226
102
214
36
30
106
238
78
30
214
36
106
254
226
36
102
30
44
107
238
78
18
109,114
107
36
102
44
18

FLEXIBLE SIGN MOUNT

CROSS-REFERENCE TO RELATED APPLICATIONS

This application claims the benefit of U.S. Provisional Application No. 60/782,334, filed on Mar. 14, 2006, the disclosure of which is incorporated herein by reference.

FIELD

The present disclosure relates to advertising displays and, more particularly, to a flexible mounting system to support a sign on a rigid structure for minimizing damage that might result from an impact force on the sign.

BACKGROUND

The statements in this section merely provide background information related to the present disclosure and may not constitute prior art.

Point-of-purchase advertising is an important aspect of many business properties. These properties utilize a variety of devices to mount and display advertising media, such as signboards, on various structures located about the property. Some of these devices may permanently secure the advertising media to a building structure or a fixture located on the property, while other devices may releasably secure the advertising media to the building structure or fixture.

Bollards, and other support objects such as trash and/or cigarette receptacles, and other generally stationary objects located on the property provide many potential locations for mounting and displaying advertising media in high-traffic areas. While mounting the advertising media in the high-traffic area is desirable to maximize exposure to passersby, mounting in these areas can frequently subject the advertising media to impacts with people, vehicles, or other objects navigating the high-traffic area. For example, bollards are commonly used around filling station islands to protect gas pumps from vehicle impacts when the vehicle is driven near or when customers open the vehicle's doors near the gas pumps. Any advertising media mounted to the bollards are subject to the impacts described above.

Presently, advertising media is rigidly secured to bollards, and the like. These rigidly secured advertising media are susceptible to damage when inadvertently side swiped or otherwise impacted by vehicles, people, or other objects. As a result, the rigidly mounted advertising media frequently sustain damage from the impact and must be repaired or replaced. Therefore, a flexibly mounted advertising medium that can absorb low to moderate impact forces and reduce the likelihood of damage resulting from impact force is desirable.

Further, bollards and the like may be disposed individually or in groups around the structures or fixtures located on the property. The spacing and grouping of bollards and the like can be non-uniform, further rendering predetermined and/or fixed mounting arrangements inadequate. The size characteristics of the bollards and the like may also be non-uniform, further rendering predetermined or fixed mounting arrangements inadequate. Therefore, an adjustably mounted advertising medium that can accommodate a wide variety of potential mounting configurations is desirable.

SUMMARY

The present disclosure is directed to a flexible sign assembly having a support bracket secured to a sign and a stationary bracket releasably securable to a rigid support structure such a bollard. A flex element is interposed between the support bracket and the stationary bracket which provides a translational degree of freedom and a rotational degree of freedom, allowing the sign to translate and/or rotate relative to the rigid support structure when subjected to an impact load. In one embodiment, the flex element includes a pair of flexible strips secured in a generally vertical orientation between the support bracket and the stationary bracket. The flexible strips may be made of a suitable elastic material such as urethane, polyvinyl-chloride, polyester or other polymeric materials. In another embodiment, the sign, support bracket, stationary bracket, and flex element are integrally formed in a single piece. In yet another embodiment, the flex element includes a pair of coil springs secured between the support bracket and the stationary bracket in a spaced apart relationship generally along the centerline of the sign.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
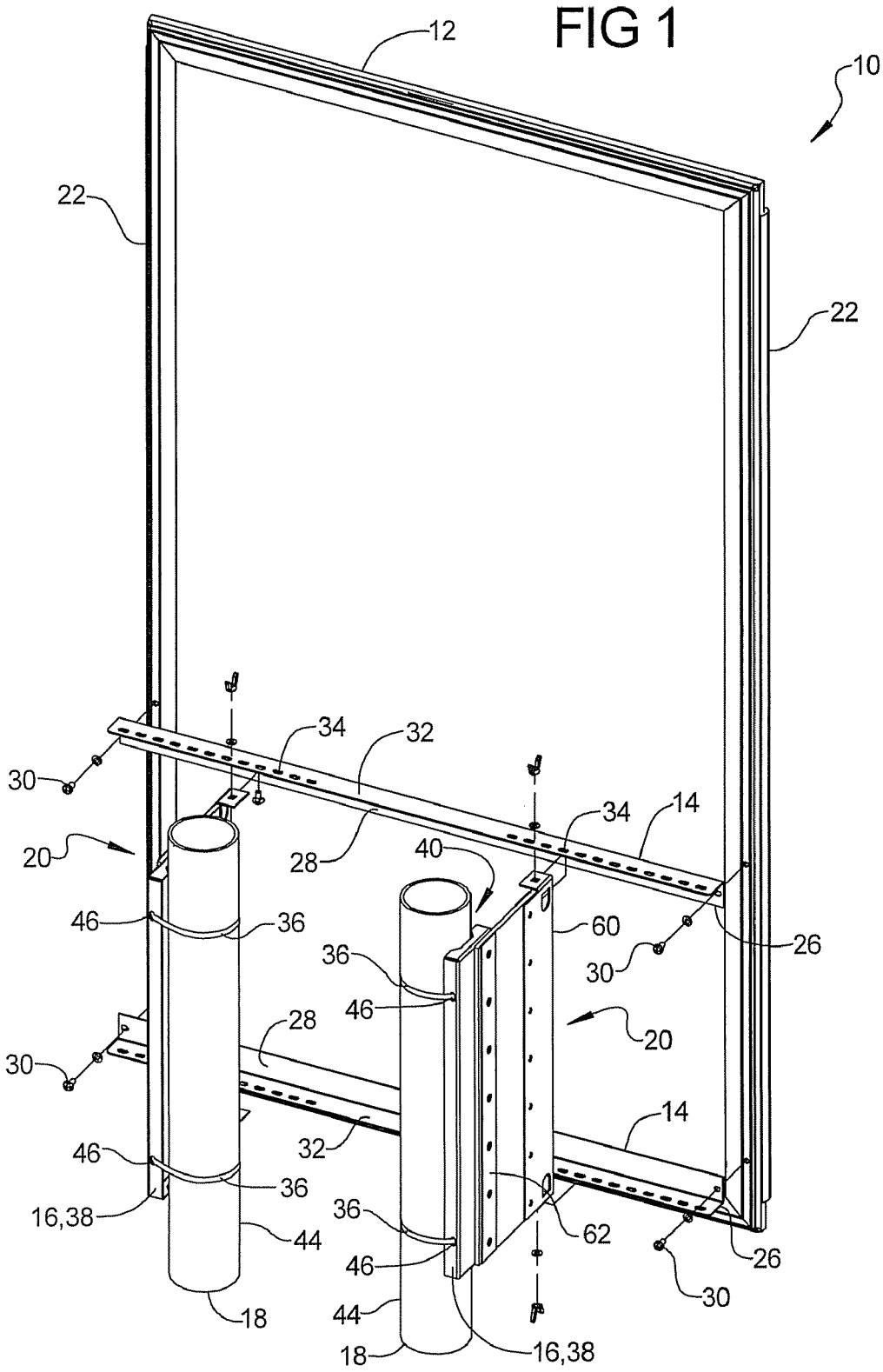
FIG. 1 is a perspective view of a first embodiment of a sign assembly having a flexible mount and attached to a pair of bollards.
Figure 2:
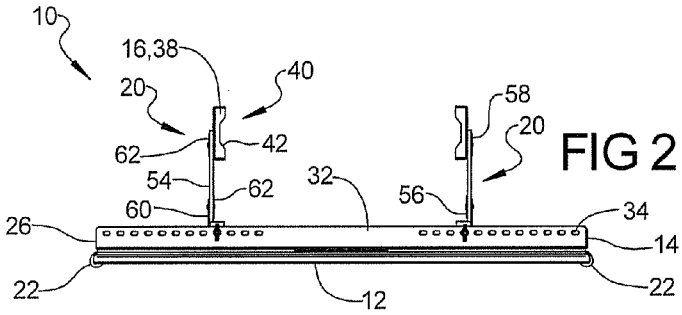
FIG. 2 is a top view of the sign assembly of FIG. 1.
Figure 3:
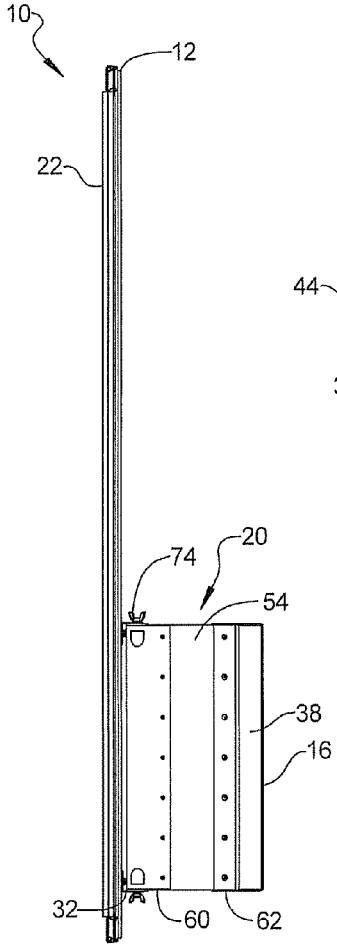
FIG. 3 is a side view of the sign assembly of FIG. 1.
Figure 4:
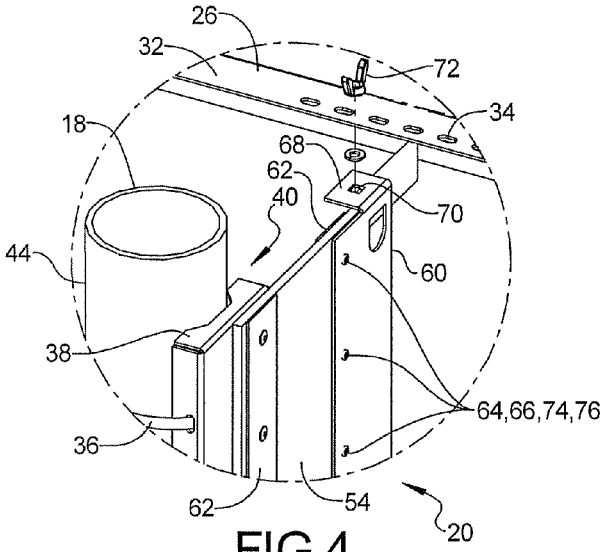
FIG. 4 is a detail view taken at A as shown in FIG. 1 and illustrating a portion of the flexible mount in greater detail.

The following description is merely exemplary in nature and is not intended to limit the present disclosure, application, or uses. It should be understood that throughout the drawings, corresponding reference numerals indicate like or corresponding parts and features.

The sign assemblies described herein include a flexible sign mount for securing a sign to a rigid support structure. The flexible mount is sufficiently elastic to allow the sign to move (i.e., translate and/or rotate) relative to the support structure when it is impacted by an object such as a vehicle but spring back into its original position when the impact load is removed. In this manner, the flexible sign mount can absorb a portion of the impact load, thereby reducing the likelihood that the impact will damage the sign and maintain the sign in a home position on the support structure when no impact load is present.

With specific reference now to FIGS. 1-4, a first embodiment of a sign assembly 10 having a flexible mount is illustrated and includes a sign 12, a support bracket 14 secured to the back of sign 12, a bollard bracket 16 secured to at least one bollard 18, and a flex assembly 20 interposed between support bracket 14 and bollard bracket 16. Sign 12 can be a conventional sign frame, such as a PosterGrip® sign available from MDI of Farmington Hills, Mich., adapted to display an advertising medium within the sign frame and secure the sign frame to a support structure. A person skilled in the art will appreciate that sign 12 can be any sign configured to display information and be mounted to a support structure.

Sign 12 may be equipped with an edge molding 22 extending along a portion of an outer perimeter of sign 12. Edge molding 22 may be a compressible material, such as closed-cell foam, that can deform when subjected to an impact force. In this manner, edge molding 22 can absorb a portion of the impact force and protect the corners and edges of sign 12 from being damaged by the impact. Edge molding 22 can simultaneously eliminate or reduce the likelihood that the impacting object will be scratched or damaged by sign 12.

Support bracket 14 can include a pair of L-shaped brackets 26 configured to secure sign 12 to flex assembly 20. Brackets 26 can be arranged in a vertically spaced relationship and have a first flange 28 secured to the back of sign 12 by fasteners 30, such as, but not limited to, threaded fasteners or rivets, and a second flange 32 extending away from sign 12. Brackets 26 have a series of elongated slots 34 formed in second flange 32 for adjustably securing flex assembly 20 to brackets 26. As presently configured, brackets 26 utilize the same design and are secured to sign 12 in a mirrored relationship relative a horizontal plane normal to sign 12. In this manner, slots 34 in the upper and lower brackets 26 can be generally horizontally aligned to accommodate a variety of mounting configurations. Specifically, this embodiment provides a sign assembly 10, and more specifically flex assembly 20, having a wide range of adjustability to accommodate attachment to multiple bollards 18, which can have on-center spacing generally ranging between about 18 inches and 43 inches, as well as an individual bollard 18.

Sign assembly 10 further includes a pair of bollard brackets 16 configured to releasably secure flex assembly 20 to bollards 18. Each bollard bracket 16 can include a pair of releasable fasteners 36 that clamps a bracket body 38 to bollard 18. Bracket body 38 can be a generally rectangular, elongate member made from a generally rigid material like, but not limited to, steel or aluminum. A contour or relief 40 that accommodates or is complimentary to a perimetrical contour of bollard 18 can be provided within bracket body 38. As presently preferred, contour 40 is trapezoidal wherein non-parallel sides 42 of contour 40 are configured to engage an outer perimeter 44 of bollard 18. The skilled person will appreciate that contour 40 can be configured having alternate shapes that can accommodate or compliment bollards 18 having different perimetrical contours, such as square bollards.

Figure 5:
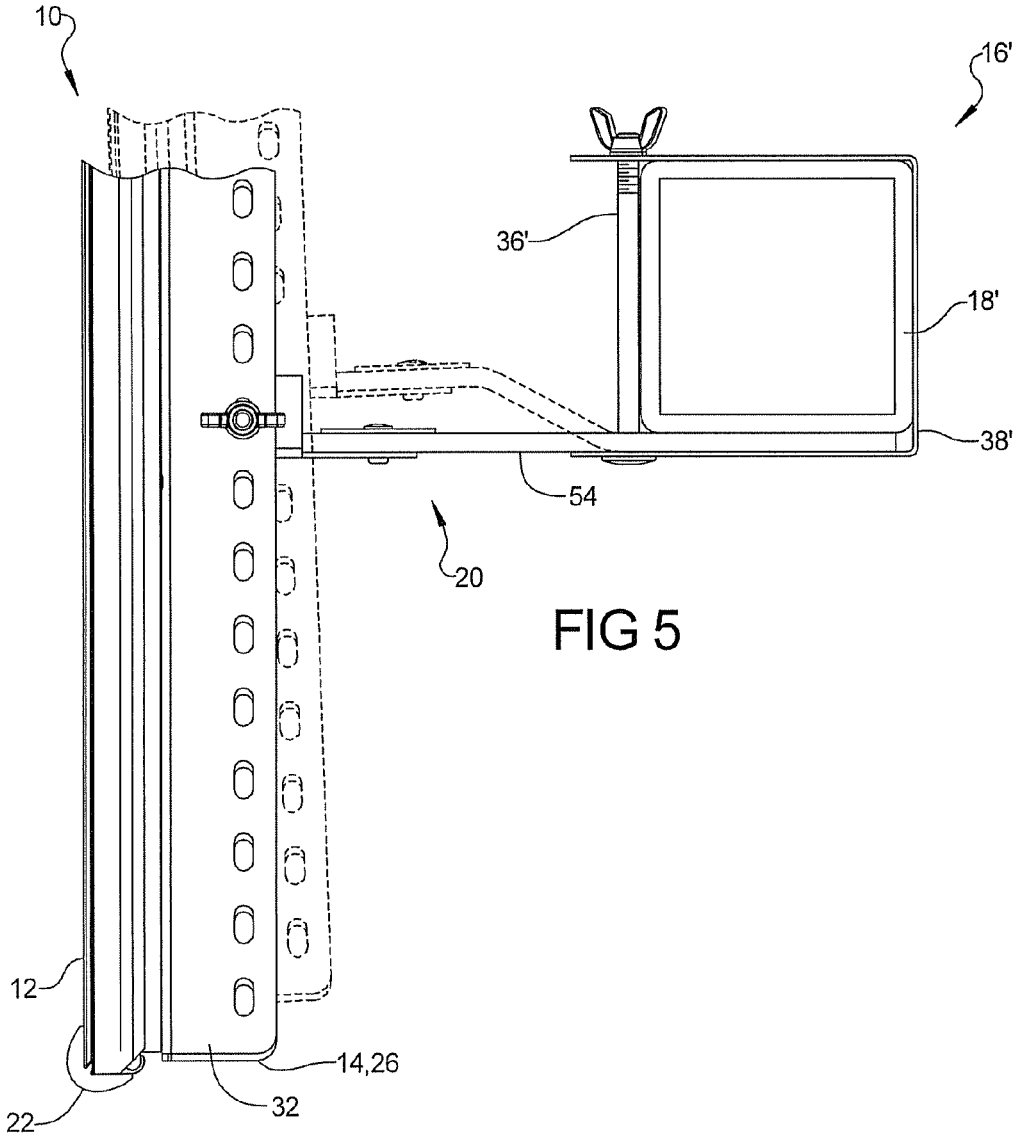
FIG. 5 is a partial view of the sign assembly of FIG. 1 having an alternate bollard bracket and illustrating relative motion of the sign assembly.

To secure bracket body 38 to bollard 18, releasable fasteners 36 may extend through pairs of apertures 46 formed in bracket body 38 and surround outer perimeter 42 of bollard 18. When cinched, fasteners 36 can draw bracket body 38 toward bollard 18 until non-parallel sides 42 of contour 40 contact outer perimeter 44. In this manner, bracket body 38 may be releasably secured to bollard 18. While fasteners 36 are illustrated in FIGS. 1-4 as hose clamps, the skilled person will appreciate that fasteners 36 may take a variety of forms including, but not limited to, metal banding or cable ties FIG. 5 illustrates an alternate embodiment of a bollard bracket 16'. In this embodiment, bollard bracket 16' comprises a bracket body 38' and a pair of fasteners 36' that secures bracket body 38' to a square bollard 18'. Bracket body 38' can be a generally U-shaped bracket configured to compliment square bollard 18'. Configured in this manner, bracket body 38' can extend around three sides of square bollard 18', and releasable fasteners 36', in the form of long carriage bolts with wing nuts, can extend through flanges of bollard bracket 16' and be tightened to secure bollard bracket 16' to bollard 18'. While not illustrated, it will be appreciated that bracket body 38' could also be configured to accommodate bollards having other perimetrical shapes, such as circular bollards.

Returning now to FIGS. 1-4, flex assembly 20 can extend between support bracket 14 and bollard brackets 16 and can include a flexible strip 54 having reinforced edges 56, 58. Flexible strip 54 can be made from a generally pliant sheet material, such as a spring steel or a polymer. In the illustrated embodiment, flexible strip 54 is a urethane strip having a thickness of approximately ¼ inch and a 60 shore durometer. Other polymeric materials, such as polyvinyl chloride or polyethylene could also be utilized. However, flexible strip 54 must be sufficiently stiff to support sign 12 in its home position, sufficiently pliant to deflect when sign 12 is subjected to an impact force, and sufficiently elastic to bias sign 12 back to the home position when the impact force is removed.

Reinforced edge 56 can be formed by securing one lengthwise edge of flexible strip 54 between a coupling bracket 60 configured to attach flexible strip 54 to support brackets 26 and a reinforcing strip 62. Coupling bracket 60 can be an elongate strip disposed adjacent a lengthwise edge of and abutting a principal planar face of flexible strip 54. Coupling bracket 60 can be made from a generally rigid material like, but not limited to, steel, aluminum, or a polymer. A plurality of attachment apertures 64, complimentary to a plurality of attachment apertures 66 disposed along a lengthwise edge of flexible strip 54, can protrude through coupling bracket 60. Coupling bracket 60 can also include a pair of mounting tabs 68 formed at both ends. An aperture 70 protruding through each of mounting tabs 68 can be configured to align with elongated slots 34 of L-shaped brackets 26, and a suitable removable fastener 72, such as a threaded fastener with a wing nut, extending through apertures 70 and slots 34 can secure coupling bracket 60 to brackets 26. Fastener 72 can be removed and accepted in slots at different locations along brackets 26. In this manner, sign assembly 10 can be adjusted to accommodate pairs of bollards having varying on-center spacing or individual bollards having varying outer perimeters.

Similar to coupling bracket 60, reinforcing strip 62 can also be an elongate strip made from a generally rigid material like, but not limited to, steel, aluminum, or a polymer. A plurality of attachment apertures 74, complimentary to apertures 66 in flexible strip 54 and apertures 64 in coupling bracket 60, can be formed in reinforcing strip 62 along a lengthwise edge. Fasteners 76, such as threaded fasteners or rivets, extending through attachment apertures 64, 66, 74 can maintain flexible strip 54, coupling bracket 60, and reinforcing strip 62 in a secured relationship. In a similar manner, reinforced edge 58 can be formed by securing an opposite lengthwise edge of flexible strip 54 between bollard bracket 16 and another reinforcing strip 62.

Figure 6:
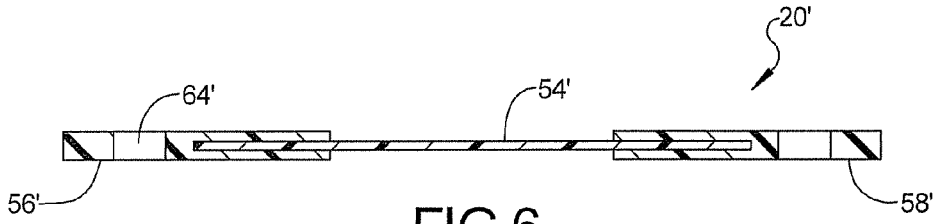
FIG. 6 is a cross-sectional view of an alternate flexible strip for the sign assembly of FIGS. 1-5.

With reference to FIG. 6, a modified flex assembly 20' is illustrated in which reinforced edges 56', 58' are integrally formed with flexible strip 54'. For example, flexible strip 54' may be formed by a co-extrusion process in which the flexible strip 54' is a polymeric material such as urethane or polyethylene having more pliant properties and reinforced edges 56', 58' are a polymeric material such as polyvinyl chloride having more rigid properties. Reinforced edges 56', 58' can have apertures 64' protruding therethrough for securing coupling bracket 60' to reinforced edge 56' and bollard bracket 16 to reinforced edge 58'.

Figure 7:
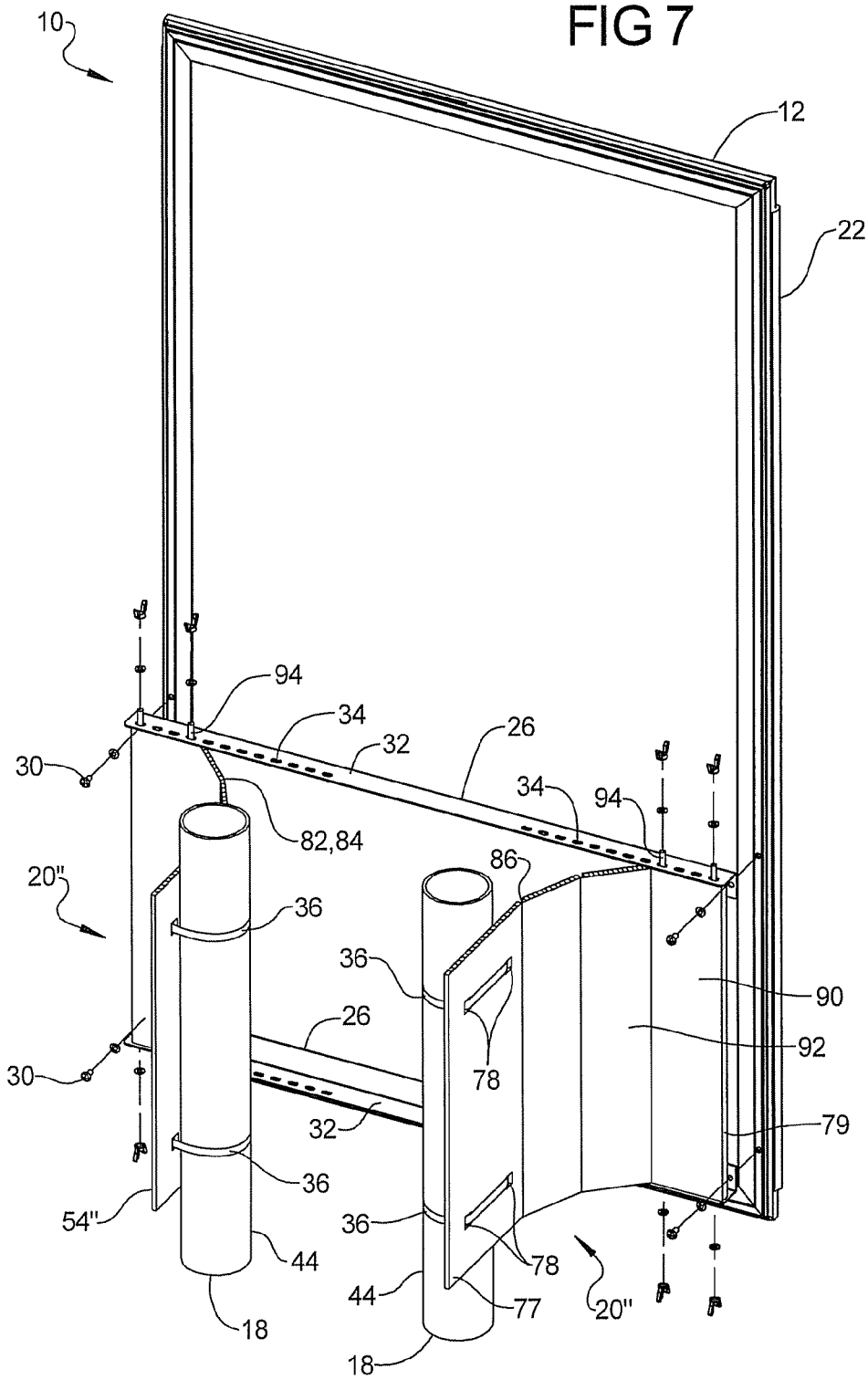
FIG. 7 is a perspective view the sign assembly of FIG. 1 having an alternate flexible mount.
Figure 8:
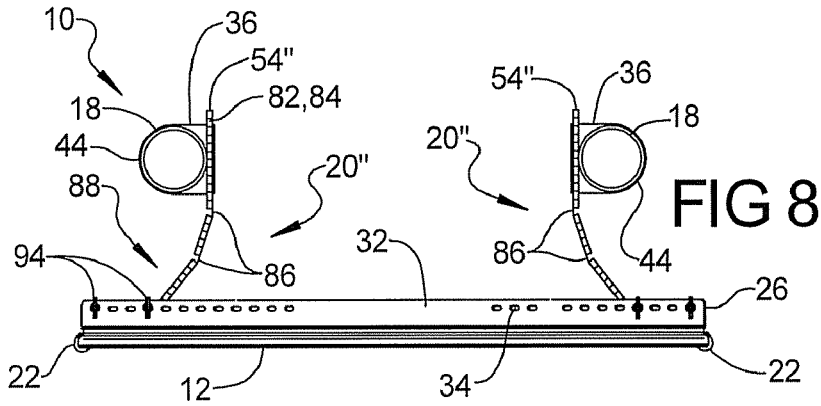
FIG. 8 is a top view of the sign assembly of FIG. 7.
Figure 9:
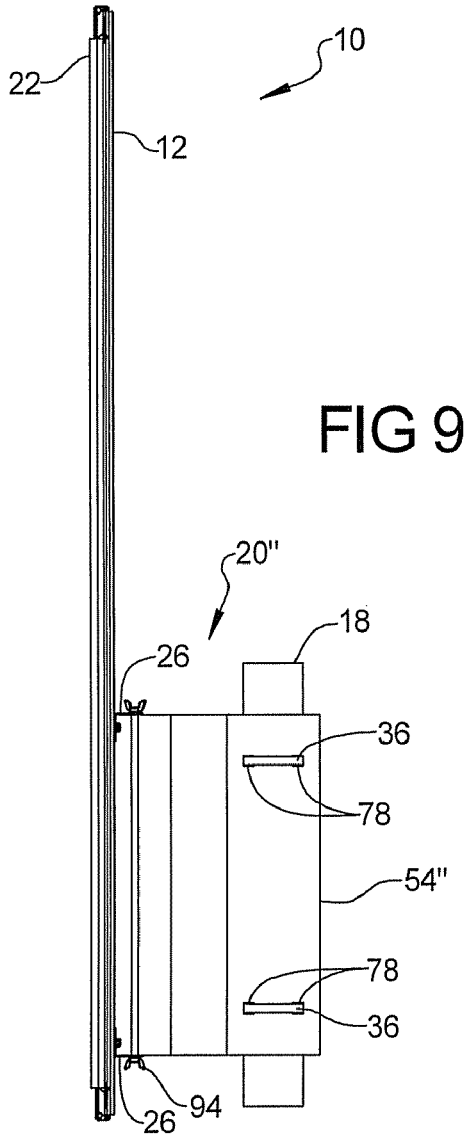
FIG. 9 is a side view of the sign assembly of FIG. 7.

With reference to FIGS. 7-9, another modified flex assembly 20" is illustrated that can be integrally formed with bollard bracket 16. Flex assembly 20" can include a pair of flexible strips 54" secured to bollard 18 on one end 77 and brackets 26 on an opposite end 79. Flexible strip 54" can be made from a generally flat sheet of extruded polypropylene and sized in a first direction to complement the spacing between upper and lower brackets 26 and in a second direction to create the desired horizontal offset between sign 12 and bollard 18. Structurally, the polypropylene sheet can include a pair of flat, parallel faces spaced about 10 mm apart and connected by a series of ribs or flutes 82 extending generally perpendicularly between the faces. Configured in this manner, the faces and ribs form a series of elongate cells 84 extending parallely along the width of flexible strip 54". Cells 84 allow flexible strip 54" to be pliable in a direction generally normal to the flat faces of flexible strip 54" and more rigid in a direction generally parallel to the flat faces of flexible strip 54".

Flexible strip 54" is preferably secured between support bracket 14 and bollard 18 with flutes 82 orientated generally vertically. Orientated in this manner, flexible strip 54" is sufficiently rigid to support sign 12 in the desirable upright position and sufficiently pliable to permit lateral movement between sign 12 and bollard 18 when sign 12 is subjected to an impact force. In addition, selectively scoring flexible strip 54" may permit additional relative lateral movement. For example, scoring one flat face of flexible strip 54" parallel and adjacent to one of flutes 82 can create a hinge 86 on the opposite unscored face. The hinge 86 is sufficiently flexible to deform and permit additional relative lateral movement. Further, by alternately scoring the opposite flat faces, flexible strip 54" can buckle to allow additional fore and aft movement. In this manner, the compliance of the flexible strip 54" may be fine tuned in the field by the sign installer.

To secure flexible strip 54" to support bracket 14, and more specifically to brackets 26, flexible strip 54" can be scored at an end disposed near brackets 26 and near one end and folded to create a generally L-shaped end portion 88. A first leg 90 of L-shaped end portion 88 can be aligned with slots 34 in brackets 26 while a second leg 92 can extend rearward away from sign 12 and toward bollard 18. A fastener 94 extending through aligned slots 34 and cells 84 can secure flexible strip 54" between upper and lower brackets 26. In this manner, flex assembly 20" is adjustably secured to support bracket 14, and fastener 94 can provide additional structural support for flex assembly 20". While fastener 94 is illustrated in FIGS. 7-9 as a threaded rod having wing nuts at both ends, it will be appreciated that fastener 94 may be any other form of threaded fastener suitable to secure flexible strip 54" and support bracket 14.

To secure flexible strip 54" to bollard 18, apertures 78 can be located near a rearward end of second leg 92 and be configured to accommodate releasable fasteners 36. Each fastener 36 can extend through one pair of apertures 78 and surround bollard 18. When cinched, fastener 36 can draw flex assembly 20" against bollard 18. The pliability of flexible strip 54" allows a portion of flexible strip 54" to conform to the contour of bollard 18. In this manner, flex assembly 20" may be supported on and releasably secured to bollard 18 in the desired position.

As illustrated in FIG. 5, sign assembly 10 provides a flexible mount for sign 12 such that when an impact force is applied to sign 12, flex assembly 20 allows sign 12 to move relative to bollard 18. In operation, the impact force is transferred from sign 12 to flex assembly 20 through support bracket 14. Flex assembly 20, more specifically coupling bracket 60, receives the impact force and distributes the impact force along reinforced edge 56. Due to the pliable nature of flexible strip 54, the transferred impact force can deform flexible strip 54 between generally rigid reinforced edges 56, 58 and create relative movement between sign 12 and bollard 18, causing sign 12 to move from the home position. Reinforced edges 56, 58 inhibit fasteners 76 from pulling out of flexible strip 54 when strip 54 receives the transferred impact force.

While FIG. 5 illustrates relative translation, depending upon the direction and magnitude of the impact force, flexible strip 54 can also permit relative rotation or a combination of relative rotation and translation. For example, bending flexible strips 54 can create movement in a lateral or side-to-side direction, while compressing and/or buckling flexible strips 54 can create movement in a longitudinal or fore-aft direction. For another example, twisting flexible strips 54 can create rotational movement about a horizontal axis. For yet another example, a combination of bending, compressing and buckling flexible strip 54 can create yaw, or rotational movement about a vertical axis. In this manner, sign assembly 10 is able to accommodate a wide variety of directional impacts upon sign 12, thereby reducing or preventing damage to sign 12 which might otherwise result from such impacts.

When it deforms, flexible strip 54 can behave like a spring by converting a portion of the energy of the impact force into potential energy and storing it within flexible strip 54. When free of the impact force and impact object, the stored energy is converted into kinetic energy and causes flexible strip 54 to return to its original non-deformed state which returns sign 12 to the home position. By adjusting the properties of flexible strip 54, such as thickness, shore durometer, and size, the spring-like behavior can be optimized to maintain sign 12 in contact with the impacting object during the impact event. In this manner, the likelihood of damage to the sign 12 or the impacting object due to spring back of sign 12 can be reduced.

In addition, the materials of flex assembly 20, and more particularly flexible strip 54, can have inherent damping characteristics that can reduce audible noises generated by flexible sign assembly 10.

Figure 10:
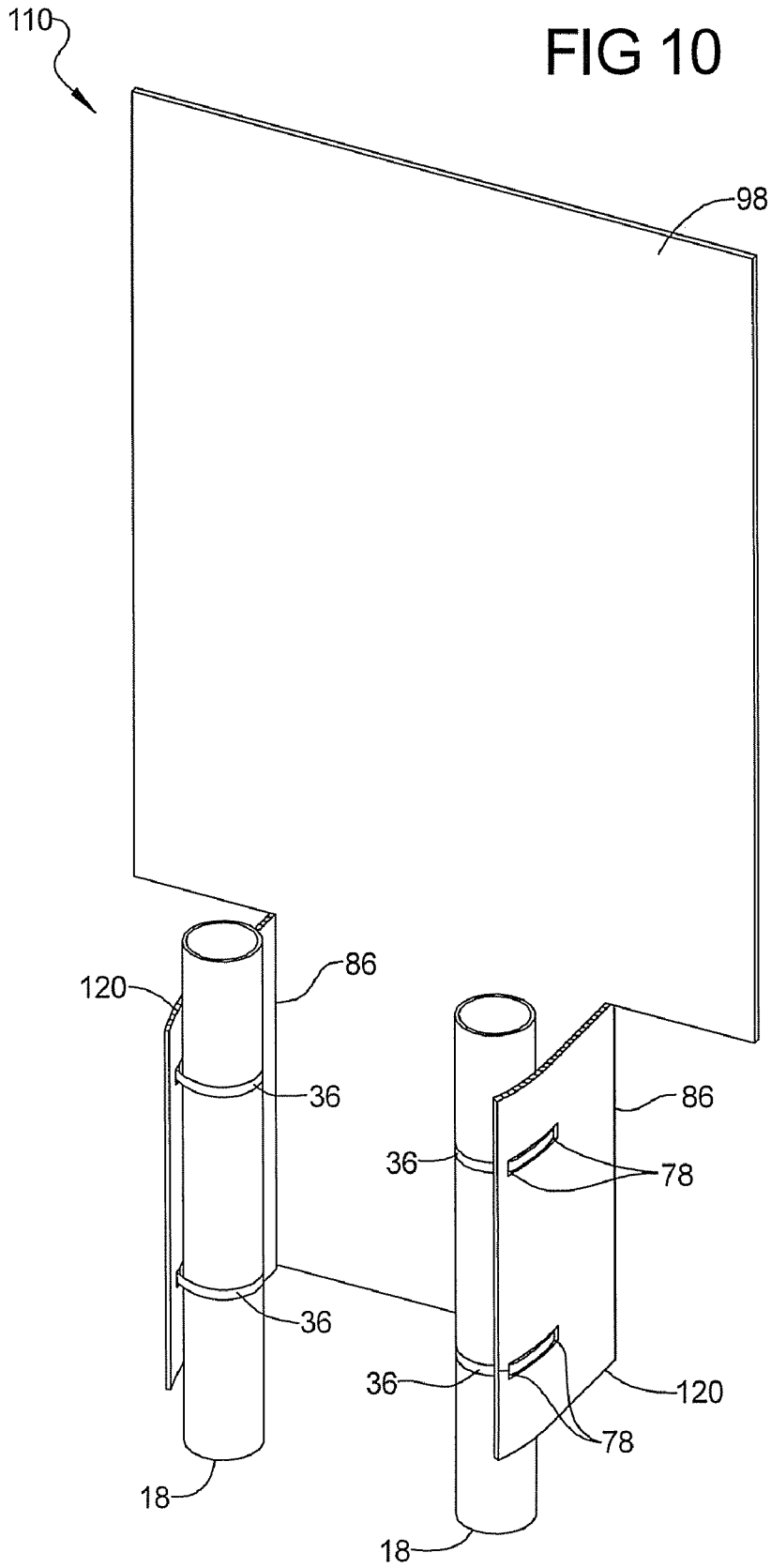
FIG. 10 is a perspective view of a second embodiment of a sign assembly having a flexible mount and attached to a pair of bollards.
Figure 11:
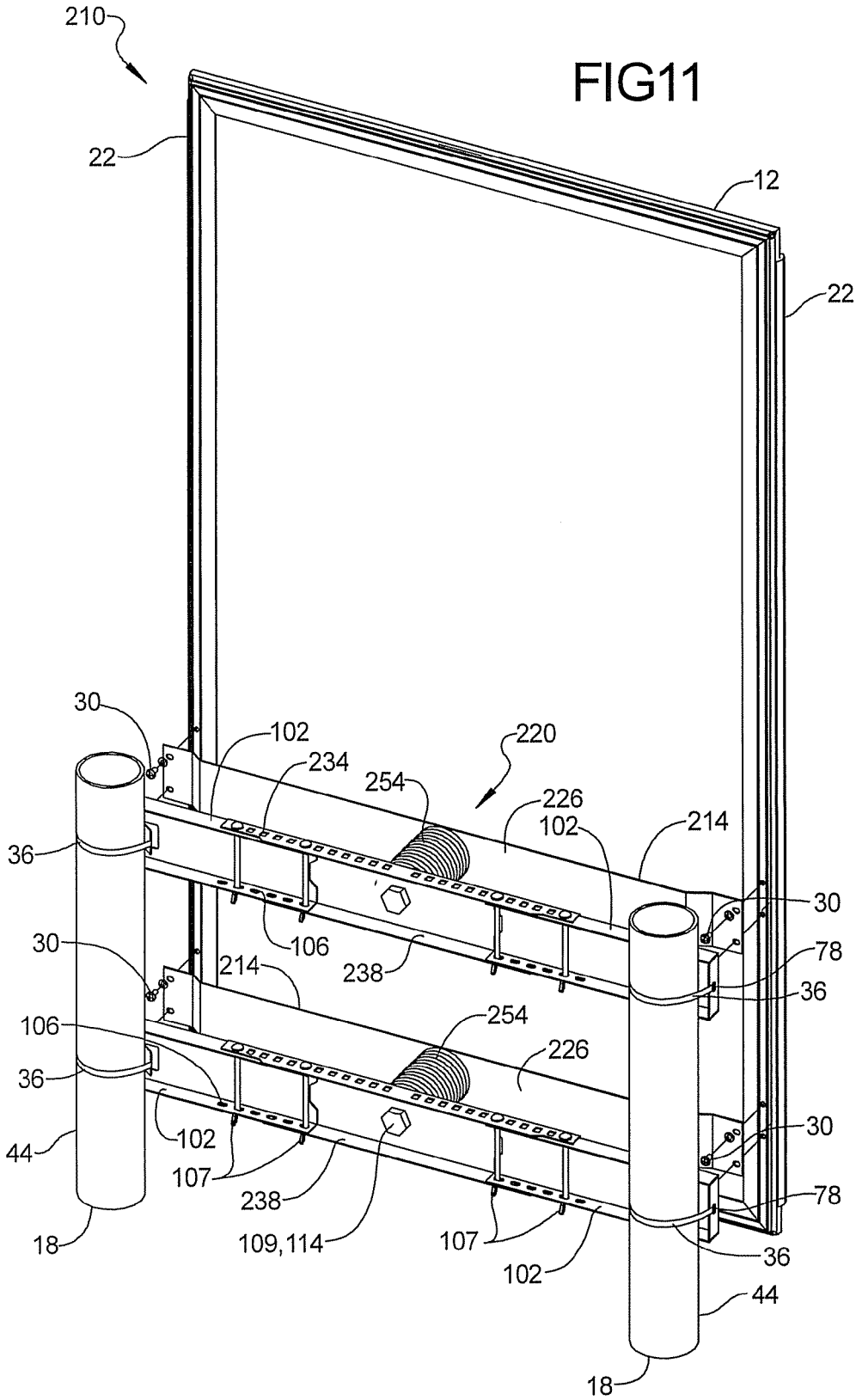
FIG. 11 is a perspective view of a third embodiment of the sign assembly having a flexible mount and attached to a pair of bollards.
Figure 12:
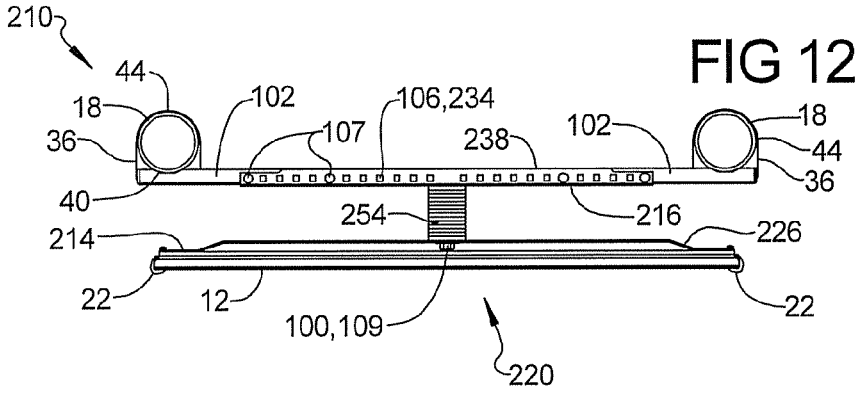
FIG. 12 is a top view of the sign assembly of FIG. 11.

With reference now to FIG. 10, a second embodiment of the flexible sign assembly is illustrated wherein sign 12, support bracket 14, bollard bracket 16, and flex assembly 20 are integrated into one piece to form flexible sign assembly 110. It should be understood that throughout the drawings, corresponding reference numbers incremented by 100 indicate like or corresponding parts and features between the first and second embodiments. Flexible sign assembly 110 can include a body 98 configured to display an advertising content and flex arms 120 extending rearward from body 98 and securable to bollards 18.

Body 98 can be made from a generally flat corrugated sheet of extruded polypropylene, as previously discussed, and shaped and sized as desired to display the advertising content, which can be printed directly on a front face of body 98. In the flat state, body 98 can be configured to included flex arms 120. Flex arms 120 can be scored on the front face of body 98 to create a living hinge 86 and thereafter folded at living hinge 86 to extend flex arms 120 rearward toward bollards 18. Fasteners 36 can surround bollard 18 and extend through a pair of apertures 78 configured to receive the fastener. When cinched, the fastener can draw flex arm 120 against bollard 18 to support flexible sign assembly 110 on bollard 18.

Polypropylene flex arm 120 is sufficiently pliable to permit relative translation and relative rotation between body 98 and bollard 18 when flexible sign assembly 110 is subjected to an impact force. The living hinge 86 is sufficiently flexible to deform and permit additional relative lateral movement. Further, by alternating scoring on the opposite flat faces, flex arms 120 can buckle to allow additional fore and aft movement. In this manner, flexible sign assembly 110 is sufficiently pliable to absorb a portion of the impact force but sufficiently elastic to return body 98 to the home position when the impact force is removed.

With reference now to FIGS. 11-14, a third embodiment of the flexible sign assembly is illustrated. It should be understood that throughout the drawings, equivalent reference numbers indicate equivalent parts or features common to the different embodiments while corresponding reference numbers incremented by 200 indicate like or corresponding parts and features between the first and third embodiments. A flexible sign assembly 210 includes a sign 12, a support bracket 214 secured to the back of sign 12, a bollard bracket 216 secured to and spanning a pair of bollards 18, and a spring assembly 220 interposed between support bracket 214 and bollard bracket 216 and providing a flexible mount between sign 12 and bollards 18.

Support bracket 214 can include straps 226 secured to and supporting sign 12 in a generally vertical home position. Straps 226 can be arranged in a vertically spaced relationship and secured to sign 12 by fasteners 30. As presently preferred, straps 226 utilize the same design and can be strips of generally rigid material such as, but not limited to, steel or aluminum, formed to structurally support spring assembly 220 on sign 12 at apertures 100.

Bollard bracket 216 can be a pair of bollard brackets 216, each comprising a bracket body 238 supported by a pair of lateral extensions 102 received by bracket body 238 and secured to bollards 18. Bracket body 238 and lateral extensions 102 can be made from generally rigid material such as steel or aluminum. Bracket body 238 can have a generally C-shaped cross-section and include an attachment aperture 114 configured to secure and support spring assembly 220 and a series of apertures 234 in the flanges of the C-shaped cross-section configured to adjustably couple bracket body 238 and lateral extensions 102.

Like bracket body 238, lateral extensions 102 can also have a C-shaped cross-section configured to be slidably received within bracket body 238 and can include a series of apertures 106 complimentary to apertures 234 in bracket body 238. Lateral rails 112 can be extended or retracted within body 234 and can be releasably secured to bracket body 238 using fasteners 107, such as threaded fasteners, extending through complimentary apertures 106, 234. In this manner, bollard bracket 216 is adjustable to span pairs of bollards 18 having different on-center spacing. A contour or relief 40, as previously described, can also be formed in lateral extensions 102 to accommodate or compliment an outer perimeter 44 of bollards 18.

Pairs of apertures 78 located in lateral extensions 102 can be configured to receive releasable fasteners 36. Fasteners 36 may surround outer perimeter 44 and support bracket body 38 on bollard 18. When fasteners 36 are cinched, lateral extensions 102 of bracket body 238 are drawn toward bollard 18 until contour 40 contacts outer perimeter 44. In this manner, bracket body 238 may be releasably secured to bollard 18 in the desired position.

Figure 14:
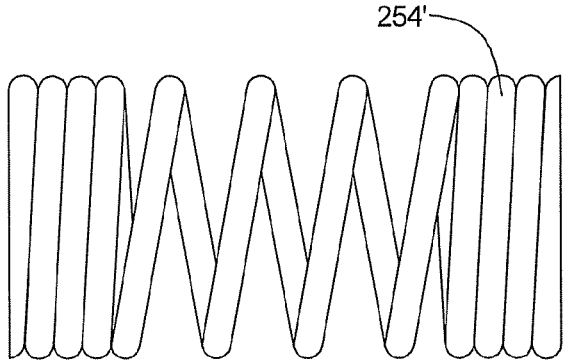
FIG. 14 is a front view of an alternate spring for the sign assembly of FIG. 11.
Figure 13:
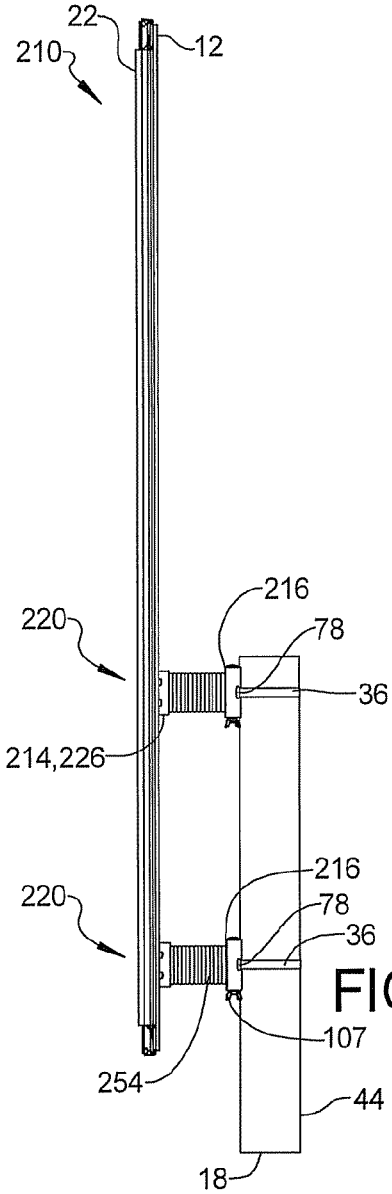
FIG. 13 is a side view of the sign assembly of FIG. 11.

Spring assembly 220 can include a pair of spring assemblies 220 secured between bollard bracket 216 and straps 226. Spring assemblies 220 can generally vertical orientated along a central, vertical plane of sign 12 and can include a spring 254 and a pair of spring seats 108 received within opposite ends of spring 254. Springs 254 can be compression springs secured in a fully compressed position and having a spring constant sufficient to support sign 12 in its home position, deflect when sign 12 is subjected to an impact force, and bias sign 12 back to the home position when the impact force is removed. It should be appreciated that other springs, such as tension springs, leaf springs, and disk springs, may be utilized in spring assembly 220. As a specific example, a modified spring 254', as illustrated in FIG. 14, having end portions configured as tension springs and a center portion configured as a compression spring could be utilized.

Spring seat 108 can have a circular pilot portion protruding from a generally flat, annular body and received by spring 136 and a center aperture extending lengthwise through spring seat 108. The center aperture can be sized to receive a fastener 109, such as a threaded fastener, while limiting undesirable relative translation therebetween. Spring seat 108 can be configured such that the circular pilot portion is received within an inner coil diameter of spring 254 and sized to limit relative translation between spring 254 and spring seat 108. The generally flat body abuts an end of spring 254 to maintain spring seat 108 at the end of spring 254. Securing spring assembly 220 between bollard bracket 216 and support bracket 214 in this manner can limit or minimize uncontrolled translation between sign 12 and bollard 18.

Sign assembly 210, and more particularly spring assembly 220, provides a flexible mount for sign 12 permitting relative motion between sign 12 and bollard 18 when an impact force is applied to sign 12. Specifically, the impact force is transferred from sign 12 to spring 254 through support bracket 214. The transferred impact force can deform spring 254 and create relative movement between sign 12 and bollard 18, causing sign 12 to move from the home position. For example, bending spring 254 can allow rotational movement about a vertical axis. For another example, deforming spring 254 such that one end of spring 254 moves planarly relative the opposite end can allow a limited amount of relative lateral, or side-to-side, translation. In addition, other spring assembly configurations that include a compressible spring, such as spring 254', can also allow relative fore and aft translation when the spring compresses.

When spring 254 deforms due to the impact force, a portion of the impact force can be stored within spring 254. When free of the impact force and impact object, the stored energy is converted into kinetic energy and causes spring 254 to return to its original non-deformed state and return sign 12 to the home position. In addition, spring-back of sign 12 can be controlled by adjusting the spring rate of spring 254 to maintain sign 12 in contact with the impacting object during the impact event.

Further, spring 254 can have inherent damping characteristics that can reduce audible noises generated by flexible sign assembly 210.

From the foregoing description, it should be appreciated that other pliant elements may be incorporated into the sign assembly described herein to provide a pliant mount. For example, a leaf type spring may be sufficiently pliant to permit relative motion between the support bracket and bollard bracket when subjected to an impact force. Alternately, gas-assisted cylinders, rubber shock mounts, disk springs or other pliant elements may be substituted for flex assembly 20 or spring assembly 220. Likewise, various damping elements may be interposed between the support bracket and the bollard bracket to control the excursion or return of the sign to its home position.

What is claimed is:

1. A flexible mount for attaching a sign to a support structure, said flexible mount comprising:

a first bracket having a first member and a second member disposed in a spaced apart relationship relative to said first member, both said first and second members connected to said sign;

a second bracket connected to said support structure; and a single flex element having a first end secured at each of said first and second members of said first bracket and a second end secured to said second bracket, wherein said flex element deflects to permit a rotation and a translation motion between said first bracket and said second bracket when a force is received by said first bracket and returns to a home position when said force is removed from said first bracket.

2. A flexible mount for attaching a sign to a support structure, said flexible mount comprising:

a first bracket having a first member and a second member disposed in a spaced apart relationship relative to said first member, both said first and second members connected to said sign;

a second bracket connected to said support structure; and a flex element having a first end secured to both said first and second members of said first bracket and a second end secured to said second bracket, wherein said flex element deflects to permit a rotation and a translation motion between said first bracket and said second bracket when a force is received by said first bracket and returns to a home position when said force is removed from said first bracket; and wherein said first and second members include a plurality of elongated slots adapted to receive a fastener for adjustably securing said flex element to said first bracket.

3. The flexible mount of claim 2, wherein said flex element comprises a flexible strip of polymeric sheet material secured vertically between said first bracket and said second bracket.

4. The flexible mount of claim 3, wherein said flexible strip includes a reinforced edge.

5. The flexible mount of claim 4, wherein said reinforced edge is a lengthwise edge and includes a coupling bracket abutting a first face of said flexible strip.

6. The flexible mount of claim 4, wherein said reinforced edge is integrally formed with said flexible strip.

7. The flexible mount of claim 6, wherein said integrally formed flexible strip is a co-extruded flexible strip and includes a first portion fabricated from a polymeric material selected from a group consisting of urethane and polyethylene and a second portion fabricated from a polyvinyl-chloride having an increased rigidity compared to said polymeric material.

8. The flexible mount of claim 2, wherein said flexible strip is made from a spring steel.

9. The flexible mount of claim 3, wherein said first bracket, said second bracket, and said flex element are integrally formed.

10. The flexible mount of claim 9, wherein said first bracket, said second bracket, and said flex element are formed from a polypropylene sheet.

11. The flexible mount of claim 1, wherein said second bracket includes a contour portion configured to compliment an outer perimeter of said support structure.

12. The flexible mount of claim 11, wherein said contour portion is a generally trapezoidal contour portion.

13. The flexible mount of claim 11, wherein said contour portion is a generally rectangular contour portion.

14. A sign assembly mountable to a support structure, said sign assembly comprising:

a sign having a generally planar display face;

a first bracket secured to said sign;

a second bracket spaced apart from said first bracket and secured to said sign;

a third bracket connected to said support structure;

a sheet material flex element interposed between and secured to both said first bracket and said second bracket and extending generally perpendicular to said first and second brackets and said display face, said flex element further connected to said third bracket, said flex element supporting said sign in a generally upright position for permitting relative motion between said sign and the support structure when said sign is subjected to an impact load and returning to a home position when said impact load is removed.

15. The sign assembly of claim 14, wherein said first bracket and said second bracket are integrally formed with said sign.

16. The sign assembly of claim 15, wherein said sign is a polypropylene sign.

17. The sign assembly of claim 16, wherein said polypropylene sign is about 10 mm thick.

18. The sign assembly of claim 16, wherein said polypropylene sign is an extruded polypropylene sign.

19. A sign mountable to a support structure, said sign comprising:

a sign body having a generally planar face;

first and second spatially separated brackets each having a first flange fastenably connected to the sign body and a second flange extending away from the sign body;

a flex element of a polymeric sheet extending generally perpendicularly from said generally planar face, said flex element having first and second oppositely positioned reinforced edges, said first reinforced edge connected to the second flange of both the first and second brackets;

a third bracket having a bracket body connected to the support structure, said second reinforced edge of said flex element also connected to said bracket body;

wherein said flex element is elastically deflectable between said first and second reinforced edges permitting movement of said sign body when said sign body is subjected to an impact load and returns said sign body to a home position when said impact load is removed.

20. The sign of claim 19, wherein said flex element comprises a pair of flex arms.

21. The sign of claim 19, wherein said sign body and said flex element are integrally formed.

* * * * *